US008152658B2

(12) United States Patent
Husband

(10) Patent No.: US 8,152,658 B2
(45) Date of Patent: Apr. 10, 2012

(54) METHOD AND APPARATUS FOR ANALYZING A PITCHED BALL

(76) Inventor: Perry Husband, Palmdale, CA (US)

( * ) Notice: Subject to any disclaimer, the term of this patent is extended or adjusted under 35 U.S.C. 154(b) by 102 days.

(21) Appl. No.: 12/504,640

(22) Filed: Jul. 16, 2009

(65) Prior Publication Data

US 2010/0081524 A1 Apr. 1, 2010

Related U.S. Application Data

(63) Continuation of application No. 11/202,857, filed on Aug. 11, 2005, now Pat. No. 7,575,526.

(60) Provisional application No. 60/601,148, filed on Aug. 11, 2004.

(51) Int. Cl.
*A63B 69/00* (2006.01)

(52) U.S. Cl. ..... 473/422; 473/453; 473/454; 473/456

(58) Field of Classification Search ..... 473/422, 473/451, 453–457
See application file for complete search history.

(56) References Cited

U.S. PATENT DOCUMENTS

| | | | |
|---|---|---|---|
| 4,461,477 | A | 7/1984 | Stewart |
| 4,515,365 | A | 5/1985 | Horikoshi et al. |
| 4,545,576 | A | 10/1985 | Harris |
| 4,563,005 | A | 1/1986 | Hand et al. |
| 5,479,008 | A | 12/1995 | Nishiyama et al. |
| 5,509,649 | A | 4/1996 | Buhrkuhl |
| 5,868,578 | A | 2/1999 | Baum |
| 6,292,130 | B1 | 9/2001 | Cavallaro et al. |
| 6,709,351 | B2 | 3/2004 | Hori |
| 7,335,116 | B2 | 2/2008 | Petrov |
| 2004/0014538 | A1 | 1/2004 | Bennett |

*Primary Examiner* — Peter DungBa Vo
*Assistant Examiner* — Damon Pierce
(74) *Attorney, Agent, or Firm* — DLA Piper LLP (US)

(57) ABSTRACT

Analysis of pitches to determine both their velocity and the location at which they arrive at the batter. The speed of the pitch is adjusted according to an adjustment value whose magnitude is a function of the location of the pitch relative to the batter. For example, high outside pitches would have a different adjustment value than low inside pitches. These adjustment values are calculated to take into account the fact that hitters must swing at different pitches at different times. That is, they must swing at some pitches earlier than others, depending on the location of the pitch. The adjusted speed, or "effective velocity," of the pitch is thus a function of both the pitch's velocity and its location relative to the batter, making it a more useful metric than velocity or location alone.

20 Claims, 9 Drawing Sheets

METHOD AND APPARATUS FOR ANALYZING A PITCHED BALL

CROSS-REFERENCE TO RELATED APPLICATIONS

This is a continuation of 11/202,857, filed Aug. 11, 2005, publication No. US2008/0035731A1, now Pat. No. 7,575,526, which claims the benefit/priority of provisional application No. 60/601,148, filed Aug. 11, 2004, all of which are hereby incorporated by reference in entirety.

BACKGROUND

1. Field

This invention relates generally to sports. More specifically, this invention relates to the analysis of a pitched ball.

2. Description of Related Information

Pitchers and hitters in sports such as baseball and softball are still commonly taught according to largely anecdotal methods that neglect various aspects of the mechanics of pitches. Conventional thought remains that by throwing pitches at various elevations, hitters will be forced to change their eye level up and down and offset their focus to many different heights. Pitchers are also taught to throw different speed pitches, in order to upset a hitter's timing. Pitchers also attempt to confuse hitters by locating the ball on the inside, outside, and middle parts of the strike zone. However, each of these aspects are often simply varied randomly, without regard to any systematic method of characterizing pitches.

Accordingly, continuing efforts exist to analyze the mechanics of pitches, and characterize them in ways that yield better instruction for both pitchers and hitters.

SUMMARY

The invention can be implemented in numerous ways, including as a method, an apparatus, and a computer readable medium. Several embodiments of the invention are discussed below.

As a method of analyzing a pitched ball from a pitcher to a batter, the pitcher and the batter separated by a first distance, one embodiment of the invention comprises measuring a first speed of the ball thrown over the first distance. A destination of the ball is located within a region proximate to the batter. A second speed of the ball is then calculated from the first speed of the ball and the destination.

Another embodiment of the invention is a computer readable medium having computer executable instructions thereon for a method of analyzing a pitched ball from a pitcher to a batter that are separated by a first distance, the method comprising measuring a first speed of the ball thrown over the first distance. Also included in the method are locating a destination of the ball within a region proximate to the batter, and calculating a second speed of the ball from the first speed of the ball and the destination.

As a method of facilitating the pitching of a ball, another embodiment of the invention comprises measuring a first speed of a ball as it is thrown from a pitcher toward a batter, and locating a destination of the ball within a region proximate to the batter. An adjusted speed of the ball is then calculated according to the first speed and the destination, so as to determine an adjusted speed of the ball.

As an integrated apparatus for analyzing a pitched ball from a pitcher to a batter that are separated by a first distance, another embodiment of the invention comprises a housing, and a speed measurement unit coupled to the housing and configured to measure a first speed of the ball thrown over the first distance. A computing unit is also coupled to the housing and configured to determine a second speed of the ball, the second speed calculated from the first speed of the ball and a destination of the ball within a region proximate to the batter. Also coupled to the housing is a display unit configured to display the second speed.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention, together with further objects and advantages thereof, may best be understood by reference to the following description taken in conjunction with the accompanying drawings in which.

Like reference numerals refer to corresponding parts throughout the drawings. Also, it is understood that the depictions in the figures are diagrammatic and not necessarily to scale.

DETAILED DESCRIPTION OF EXEMPLARY IMPLEMENTATIONS

In one embodiment of the invention, pitches are analyzed to determine both their speed and the locations at which they arrive at the batter. The speed of a pitch is then adjusted according to an adjustment value whose magnitude is a function of the location of the pitch relative to the batter. For example, high inside pitches would have a different adjustment value than low outside pitches. These adjustment values are calculated to take into account the fact that hitters must swing at different pitches at different times. That is, they must swing at some pitches earlier than others, depending on the location of the pitch. The adjusted speed, or "effective velocity," of the pitch is thus a function of both the pitch's velocity and its location relative to the batter, making it a more useful metric than velocity or location alone. Accordingly, pitchers can be taught to pitch so as to avoid patterns in the effective velocities of their pitches. Conversely, batters can be taught to look for patterns in the effective velocities of pitches, and anticipate future pitches accordingly. Embodiments of the invention thus improve the performance of both pitchers and hitters.

Figure 1:
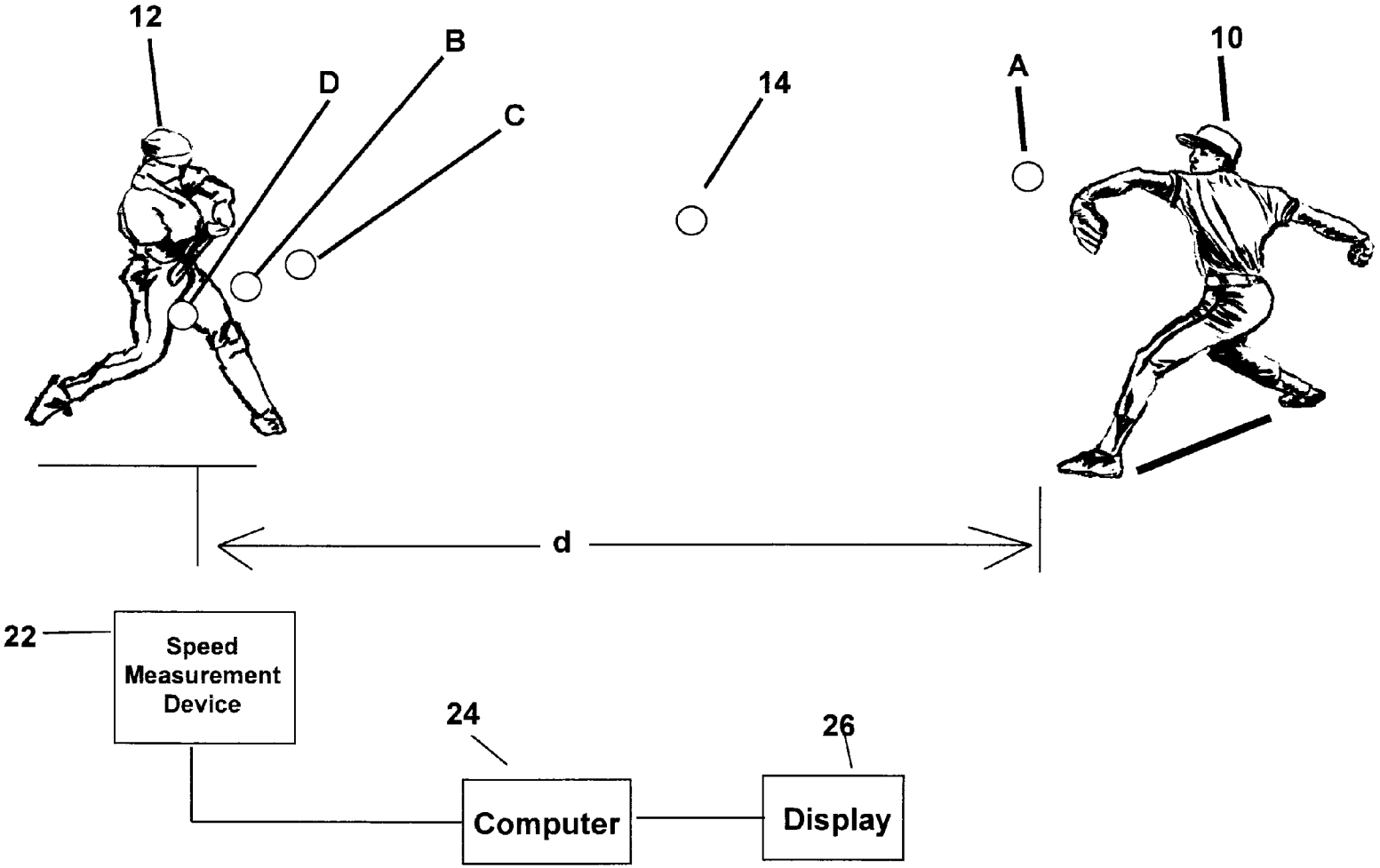
FIG. 1 illustrates an exemplary pitch from a pitcher to a batter, and a system for analyzing the pitched ball according to embodiments of the present invention.

FIG. 1 illustrates an exemplary pitch from a pitcher to a batter, and a system for analyzing the pitched ball according to embodiments of the present invention. Here, a pitcher 10 and hitter 12 are separated by a distance d, while the pitcher 10 pitches a ball 14 to the hitter 12. The speed of the pitch is determined by a measurement device 22 such as a conventional radar gun, as is the location of the ball 14 when it reaches a point close to the hitter 12 (e.g., within the strike zone, high and inside, etc.). This information is recorded and/or analyzed by a computer 24 or another such known device for recording and/or processing data. From this data, the computer 24 determines the effective velocity, or "hit reaction value," of the pitch and displays it upon the display 26. The computer 24 can record and analyze data from multiple pitches, thus determining patterns of effective velocity for display upon the display 26, where this information can be used by coaches, pitchers 10, or hitters 12.

Figure 2:
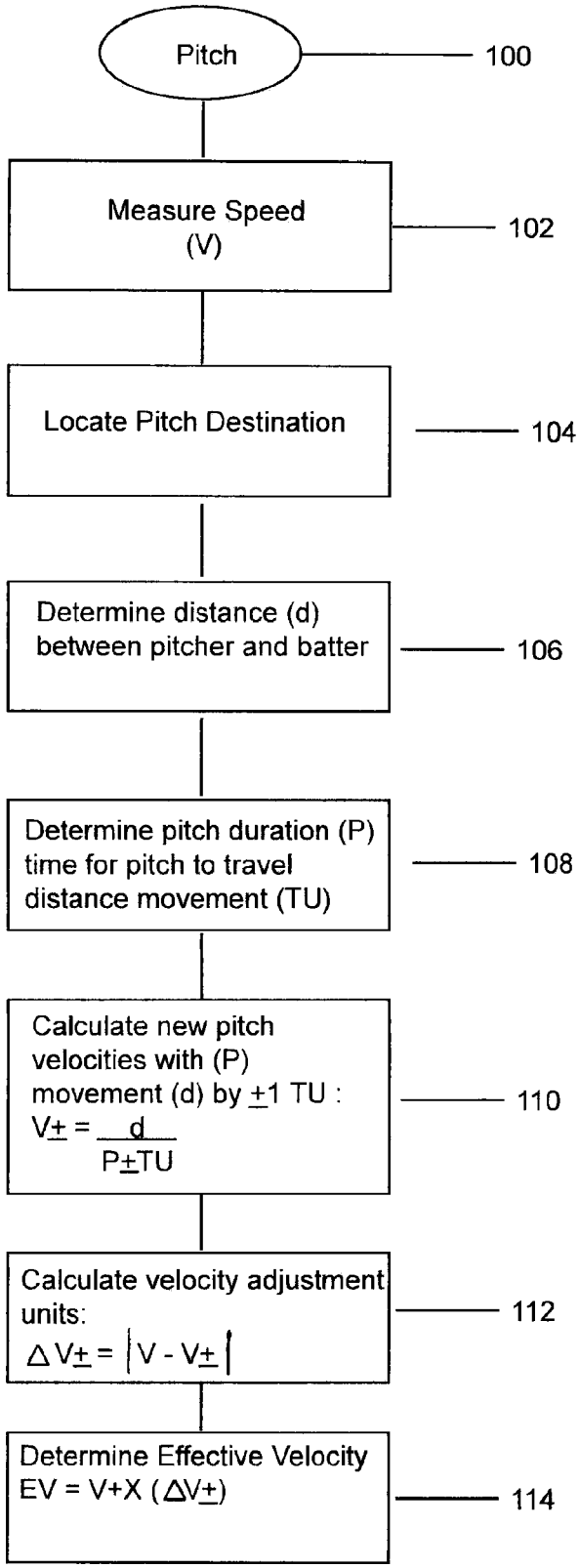
FIG. 2 illustrates process steps carried out in the analysis of a pitch.

FIG. 2 illustrates process steps carried out by the computer 24 in the analysis of a pitch. Once a pitcher 10 tosses a pitch (step 100), the measurement device 22 measures the speed V of the pitch (step 102). One of ordinary skill in the art will realize that the speed of the ball 14 varies as it is thrown from the pitcher 10 to the hitter 12, and that therefore the measured speed can be any representative speed such as the speed of the ball 14 as it leaves the hand of the pitcher 10, the average speed of the ball 14 along its path from the pitcher 10 to the batter 12, or the like. Once this speed is determined, the destination of the pitch is also determined (step 104), as is the distance d between the pitcher 10 and hitter 12 (step 106). The distance d is a function of the pitcher's height, his release point, etc., and can thus be difficult to calculate. Accordingly, the invention includes embodiments in which d is estimated. For instance, embodiments described below employ values of d equal to 54 feet, which on a professional baseball diamond is an estimate of the distance between an average professional baseball pitcher's release point, and the front edge of home plate. Here, the release point is determined assuming an average pitcher that is 6'4" tall, with a stride length of 68.4" and having a release point 6" to 12" in front of the instep of his stride foot. Of course, the invention includes embodiments in which d is set equal to alternate values.

A pitch duration P and time for the pitch to travel a specified distance increment (referred to as a time unit, TU) are then determined (step 108). The pitch duration P can be measured, or it can be calculated according to the speed of step 102 and the distance d. The time taken for the pitch to travel the specified distance increment can be determined in like manner. The specified distance increment is simply a measure of the amount by which batters 12 must vary or adjust their swing according to pitch destination, and can be determined by any known method, whether empirical, experimental, or theoretical. It has been found that a distance increment of 1.5 feet is effective for predicting the amount by which many batters 12 must adjust in order to compensate for varying pitch location. For example, a change of 8-12 inches in pitch height corresponds to approximately a 1 TU change in the effective velocity of the pitch, making 1.5 feet a convenient value. As this quantity can be selected at least somewhat on the basis of convenience, the invention includes the use of many different values of this specified distance increment.

Once these quantities have been found, adjusted velocities $V_{\pm}$ are determined (step 110). These adjusted velocities are determined according to the formula:

$$V_{\pm} = \frac{d}{P \pm TU} \tag{1}$$

Note that two adjusted velocities are calculated: one each for positive and negative values of TU. Velocity adjustment units $\Delta V_{\pm}$, or the difference between the measured speed V and the new adjusted velocities, are then calculated (step 112):

$$\Delta V_{\pm} = |V - V_{\pm}| \tag{2}$$

An adjusted speed, or effective velocity EV, is then calculated as (step 114):

$$EV = V + X(\Delta V_{\pm}) \tag{3}$$

where

X=a multiplier, determined as described below

As will be explained below, the value of X can be positive or negative. If X is positive, $\Delta V_{+}$ is used in equation (3), whereas if X is negative, $\Delta V_{-}$ is used. So for positive values of X:

$$EV = V + X\left|V - \frac{d}{P + TU}\right| \tag{4}$$

and for negative values of X:

$$EV = V + X\left|V - \frac{d}{P - TU}\right| \tag{4}$$

Attention now turns to the multipliers X of step 114, and their determination. In one embodiment, the multiplier values can be determined as numerical values that vary according to spatial location of the pitch relative to the batter 12 (as the pitch passes the batter). More specifically, the strike zone and "pressure zone" (i.e., the region surrounding the strike zone) are divided into a number of regions, each of which is assigned a numerical multiplier value. When a ball 14 is pitched through one of these regions, that region's multiplier value is used as the value of X to calculate EV, according to equation (3).

In one embodiment, the strike zone and pressure zone are collectively divided into a 5×5 array of regions, representing 25 contact points that are reachable by the batter 12. In this embodiment, the strike zone is divided into nine regions that are each approximately six inches wide by about eight inches high (the dimensions of the regions will vary, as the total height of the strike zone is commonly defined as extending from the knees of the batter 12 to his/her armpits, so that different batters 12 will have their own unique strike zones), and the pressure zone is divided into 16 regions of the same dimensions.

Figure 3B:
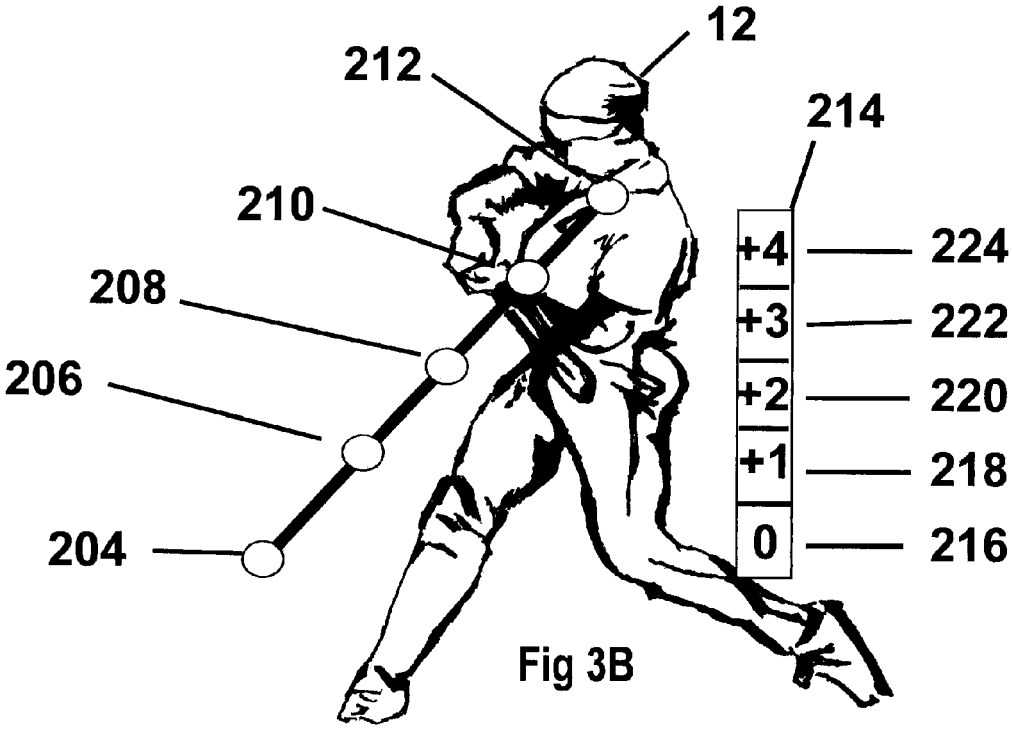
FIGS. 3A-3B illustrate elevation levels of a pitch and associated contact points for a hitter, as characterized according to embodiments of the present invention.
Figure 3A:
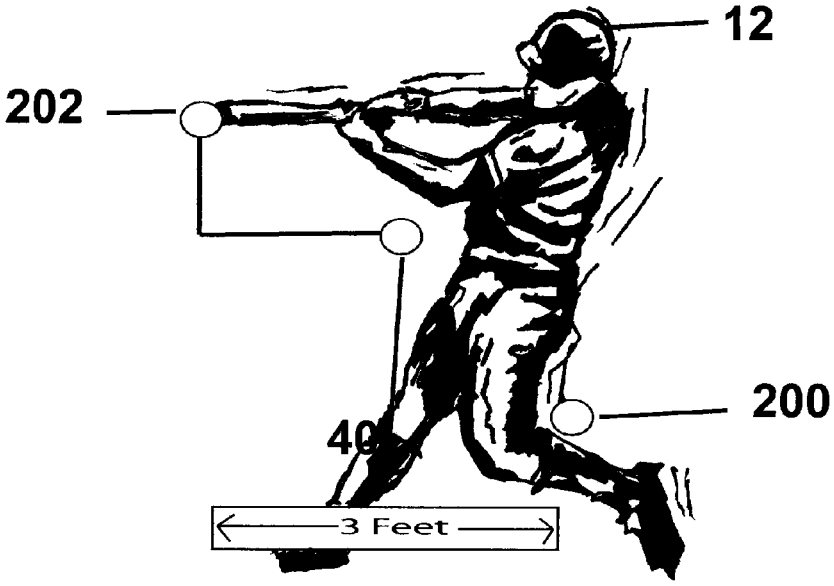

The 5×5 array can be thought of as a division of the strike and pressure zone into five elevation levels, each having five lateral location lanes. Accordingly, a ball 14 passing through the strike or pressure zones will pass through one of the five lateral location lanes on one of the five elevation levels. FIG. 3A illustrates a side view of the strike and pressure zones, with the lower portion 200 and upper portion 202 of the zones marked as shown. The area between these portions 200, 202 is subdivided into five equal regions, each representing a height at which the pitch can be hit by the batter 12. However, it will be recognized that pitches thrown to different heights must be contacted at different points by the batter 12. Accordingly, the batter 12 must initiate his swing at different times, and employ slightly different swing mechanics, in order to properly contact a ball 14 thrown at different heights. FIG. 3B graphically illustrates this concept, with each of the five balls 204-212 representing one of the five elevation levels of the 5×5 array, and roughly showing the different points at which the batter 12 must contact the balls 204-212 in order to make "100% on time" contact, or contact between the balls 204-212 with the sweet spot of the bat, and with his or her arms at full extension.

Thus, the 100% on time contact point varies according to the height of the pitch. As shown in FIG. 3B, the 100% on time contact point extends farther out from the batter 12 with decreasing pitch height. That is, lower pitches can be swung at later, while higher pitches, for 100% on time contact, must be swung at relatively earlier. Accordingly, higher pitches generally have greater "effective velocities" as they must be swung at sooner than lower pitches, whose velocities are effectively lower. The five elevation levels are therefore assigned multipliers 216-224 that increase according to elevation. Increasing pitch elevation will thus result in using an increasing value of the multipliers 216-224, resulting in increased adjusted speed EV (e.g., a ball 212 pitched high will be assigned a multiplier X of +4, whereas a ball 204 pitched low will be assigned a multiplier of 0, and thus will not have its speed adjusted at all). From step 112 of FIG. 2 then, effective velocity increases with pitch height. In this particular embodiment, multipliers X 216-224 are assigned values from 0-4 for purposes of illustrating the general concept, although it will be observed that the invention encompasses the use of any appropriate numerical values.

Figure 4:
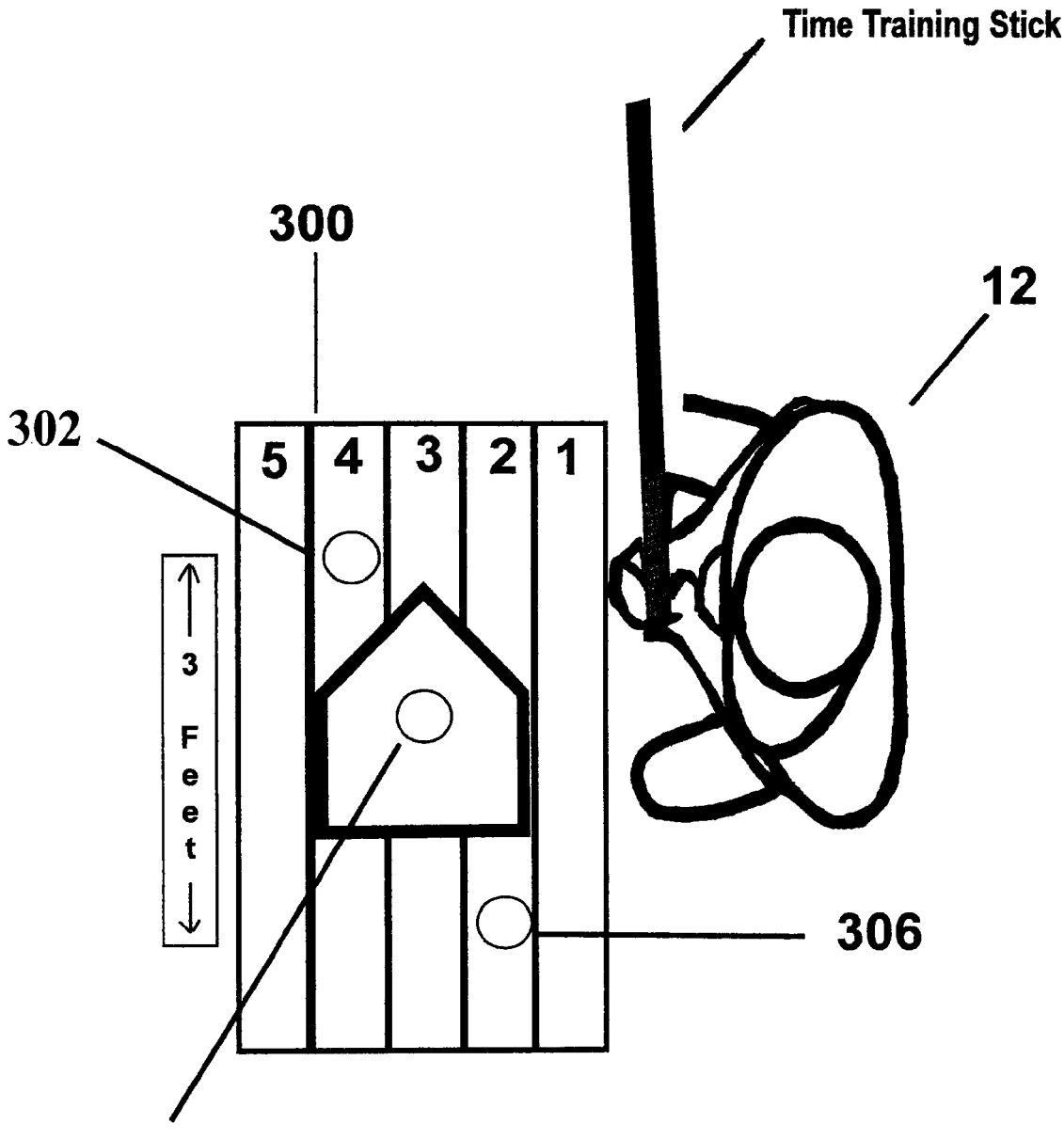
FIG. 4 illustrates lateral location lanes of a pitch and associated contact points for a hitter, as characterized according to embodiments of the present invention.

In addition to being divided into five elevation levels, the strike and pressure zones are also divided into five lateral location lanes. FIG. 4 graphically illustrates these five lateral location lanes. As shown, the collective strike and pressure zones 300 are divided into five lanes, representing five conceptual lanes through which a pitch can pass. It can be seen that, as with pitch elevation, the 100% on time contact point also varies with a pitch's lateral location. The balls 302-306 roughly illustrate these points as a function of lateral location, demonstrating that pitches thrown closer to the hitter 12 can be swung at later, while pitches thrown farther from the hitter 12 must be swung at earlier. As such, pitches closer to the hitter 12 have a greater effective velocity than pitches farther from the hitter 12, as they must be swung at sooner than a farther pitch with the same speed. Multipliers X will therefore vary according to lateral lane, typically decreasing with distance from the hitter 12.

Figure 5A:
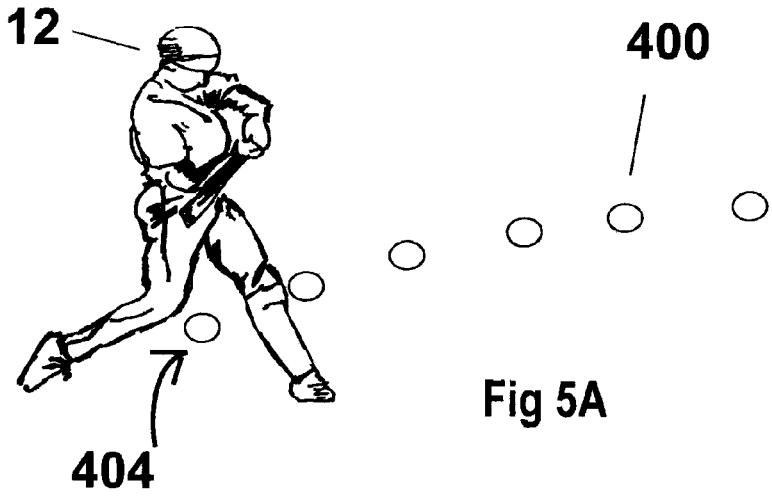
FIGS. 5A-5B respectively illustrate pitches approaching a batter, and an array of multiplier values as determined by elevation levels and lateral location lanes.

From the above, it is recognized that effective batting must take into account not just pitch speed, but also pitch location, i.e., the location at which the pitch enters the strike/pressure zone. Accordingly, as embodiments of the invention determine an effective velocity of a pitch that takes into account both speed and location, the invention yields a metric capable of more accurate pitch characterization. FIG. 5A graphically illustrates this concept, roughly showing that the positions of 100% on time contact points 400 vary in three dimensions according to pitch position and speed.

Figure 5B:
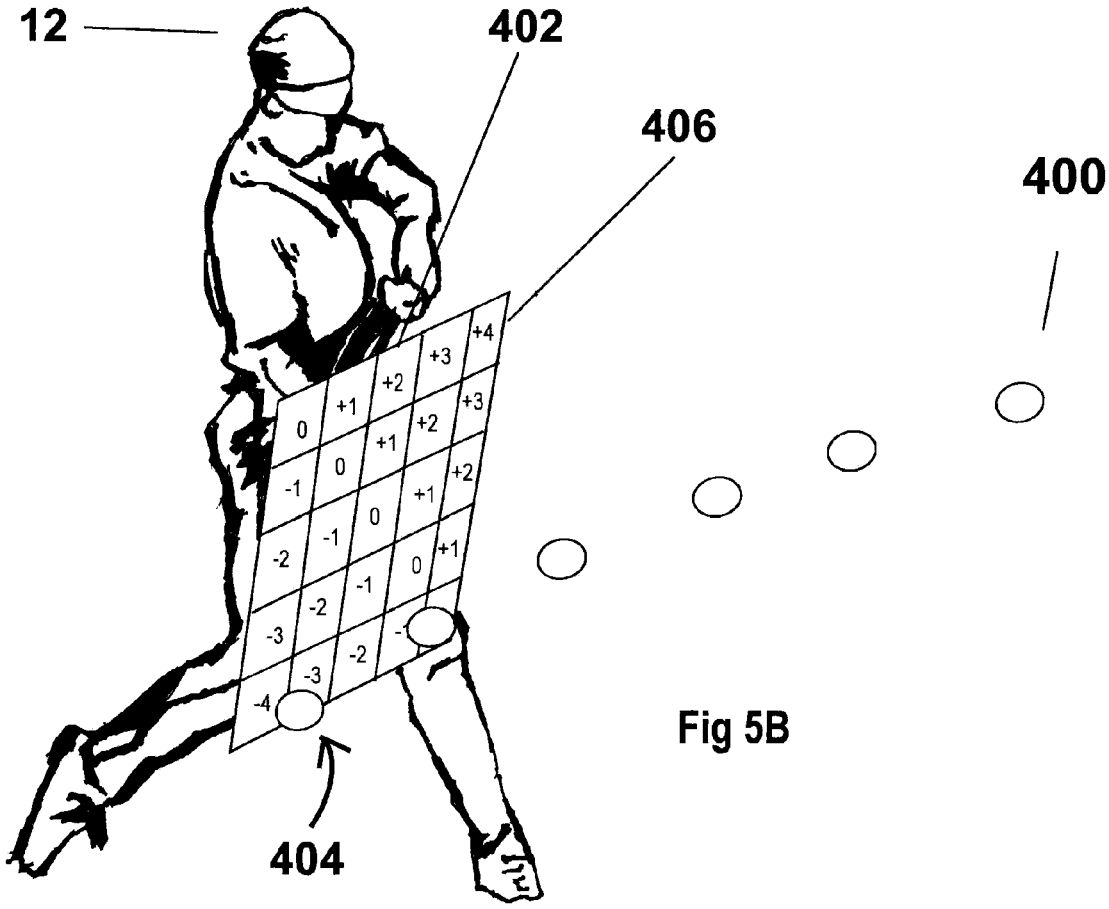

For purposes of clarity, FIG. 5B illustrates an isometric view of a 5×5 array 402 configured according to the invention, and showing exemplary multipliers X for pitches pitched to various locations. FIG. 5B is a three dimensional illustration of the concepts explained in FIGS. 3A-3B and FIG. 4, where multipliers X increase both with increasing elevation, and decreasing lateral distance from the hitter 12. For example, a pitch thrown low and outside may enter the strike/pressure zone at subregion 404 and can be hit relatively late. It can therefore be assigned a multiplier of −4, reducing its effective velocity. In contrast, a pitch thrown high and inside may enter the strike/pressure zone at subregion 406, and must be hit earlier. It can thus be assigned a multiplier of +4, increasing its effective velocity over its actual, or measured, speed.

Figure 6A:
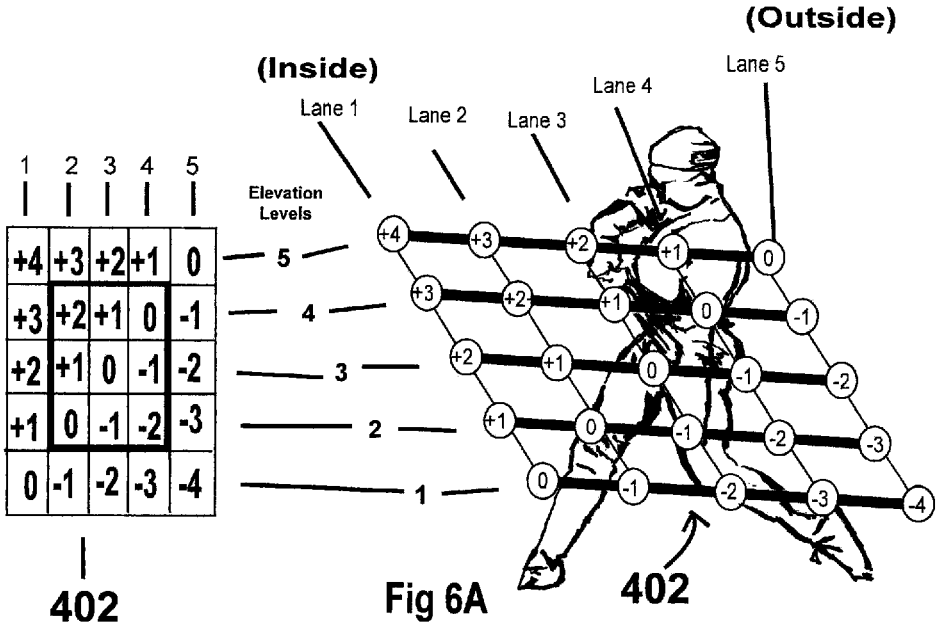
FIGS. 6A-6B respectively illustrate an array of multiplier values and an array of effective velocities for a 90 mph pitch thrown to various contact points.

For purposes of further explanation, FIG. 6A illustrates the 5×5 array 402 (inverted for a left-handed hitter 12, instead of the right-handed hitter 12 of FIG. 5B), more clearly illustrating the five elevation levels and lateral lanes, and their corresponding exemplary multiplier values. In operation, a pitcher 10 will pitch the ball 14 and the measurement device 22 will measure its speed V. The distance d is also measured (or known). The pitch will then intersect the 5×5 array at a particular elevation level and lateral lane, and is assigned the corresponding multiplier X from the array 402. From V, a correct value of TU is determined and used to determine $\Delta V_{\pm}$ using equations (1) and (2). Finally, an effective velocity is then determined using the appropriate values of X and $\Delta V_{\pm}$ using equation (3). As the determination of this effective velocity accounts for both pitch location (where it intersects the array 402) and speed, it more accurately represents the speed at which the batter 12 must perceive this ball 14 and begin to react, in order to make 100% on time contact.

Figure 6B:
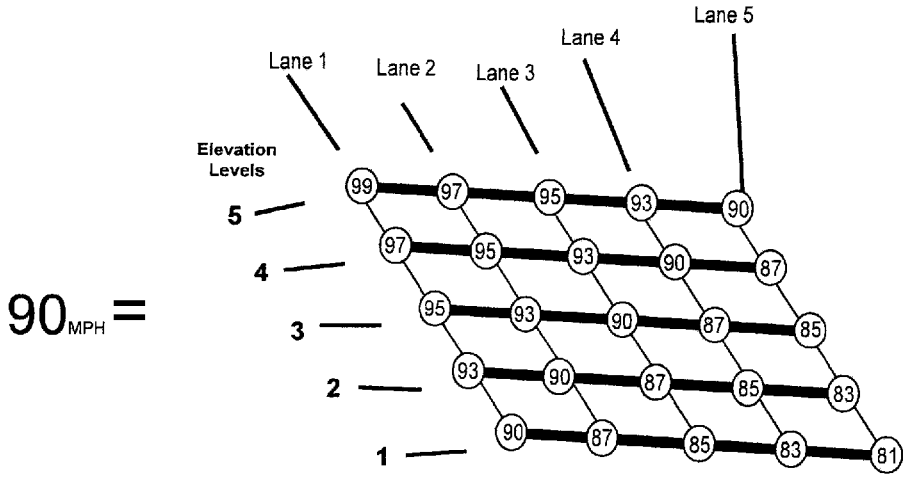

FIG. 6B illustrates an example of effective velocities calculated for a 90 mph pitch intersecting the array 402 at the locations shown, for distance d=54 feet, and using the multiplier values of FIG. 6A. FIG. 6B shows how effective velocity varies according to pitch location, i.e., increasing with increasing elevation, but decreasing with distance from the hitter 12. As can be seen, in order to hit a high inside pitch with 100% on time contact, batters 12 must swing at a 90 mph pitch as if it had an effective velocity of 99 mph. Conversely, hitting a low outside pitch with 100% on time contact requires swinging at a 90 mph pitch as if it were thrown at 81 mph.

Figure 7B:
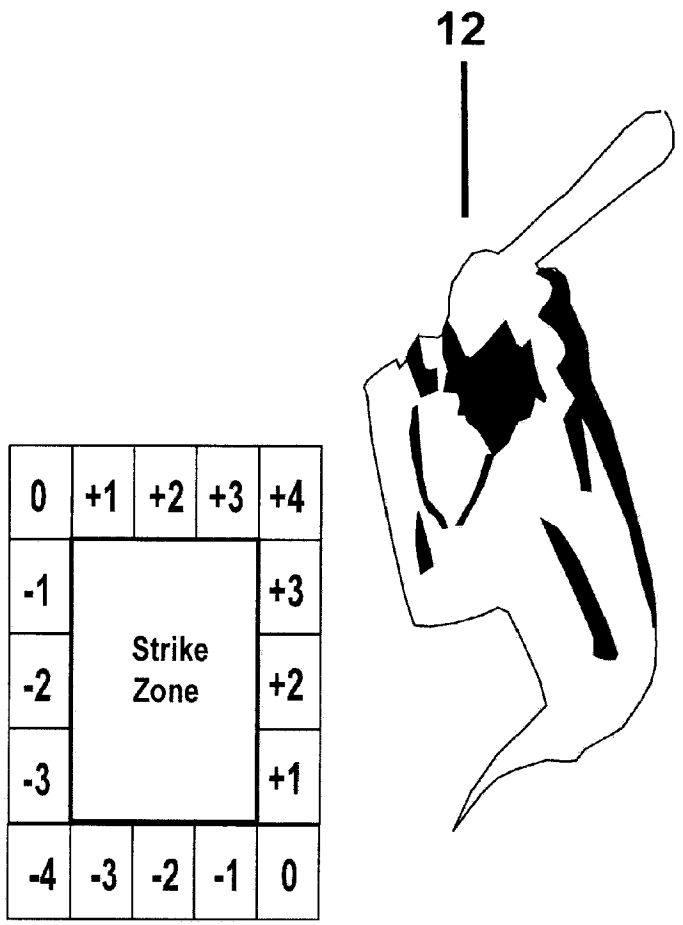
FIGS. 7A-7B respectively illustrate a right-handed hitter's strike zone and pressure zone divided into arrays of multiplier values.
Figure 7A:
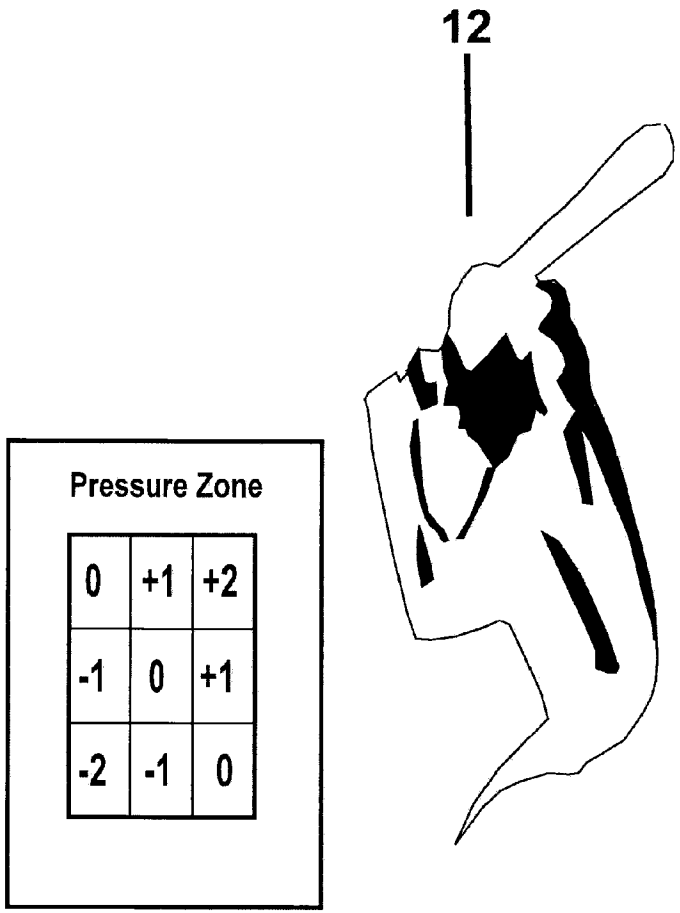
Figure 8A:
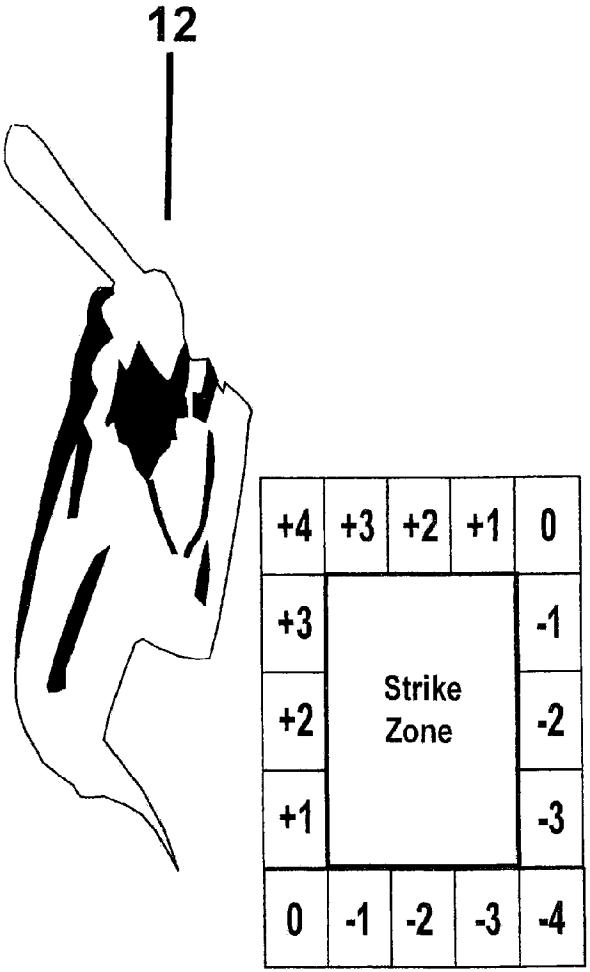
FIGS. 8A-8B respectively illustrate a left-handed hitter's strike zone and pressure zone divided into arrays of multiplier values.
Figure 8B:
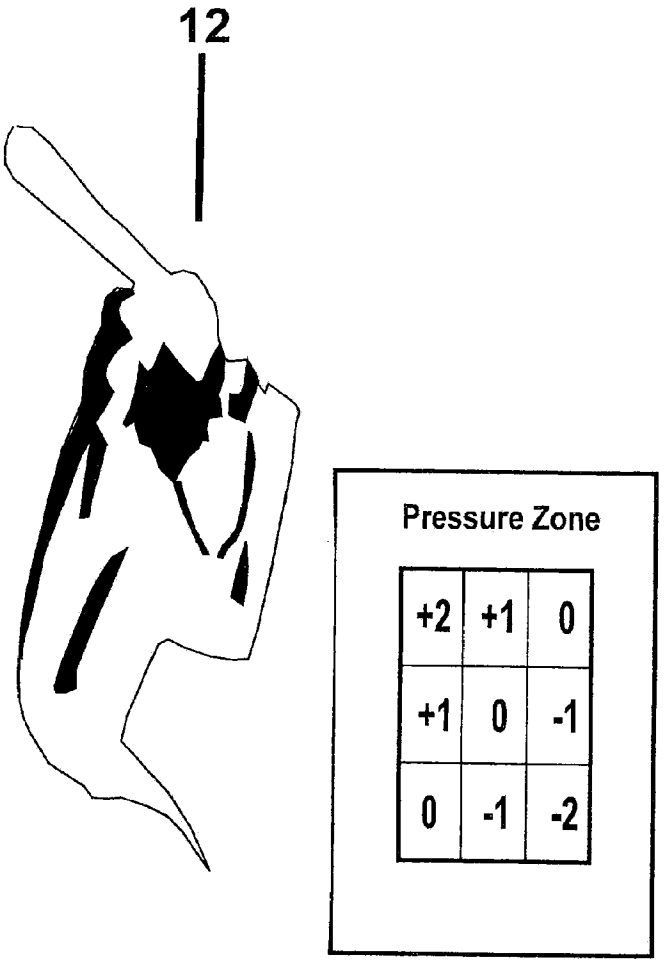

One of ordinary skill in the art will realize that the invention need not be limited to embodiments that divide the strike and/or pressure zones into 5×5 arrays, but rather simply discloses the division of a region close to the batter 12 into subdivisions, and the assigning of multipliers to these regions. Similarly, the invention is not limited to the division of only the strike and pressure zones. Rather, embodiments of the invention can subdivide only the strike zone or only the pressure zone, if these are the only zones of interest. For example, FIGS. 7A-7B illustrate the subdividing of, respectively, just the strike zone and just the pressure zone of a batter 12, for a right-handed batter. Likewise, FIGS. 8A-8B illustrate the subdividing of just the strike and pressure zones for a left-handed batter 12. Embodiments of the invention can also utilize regions proximate to the batter 12 besides the strike and/or pressure zones, designating that region in any manner appropriate for analyzing pitches. Additionally, the invention is not limited to the assignment of multipliers having values shown in FIG. 3B or FIG. 5B. It should be recognized that these values are for purposes of illustration, and the invention encompasses the use of any values appropriate in characterizing a pitch.

Figure 9A:
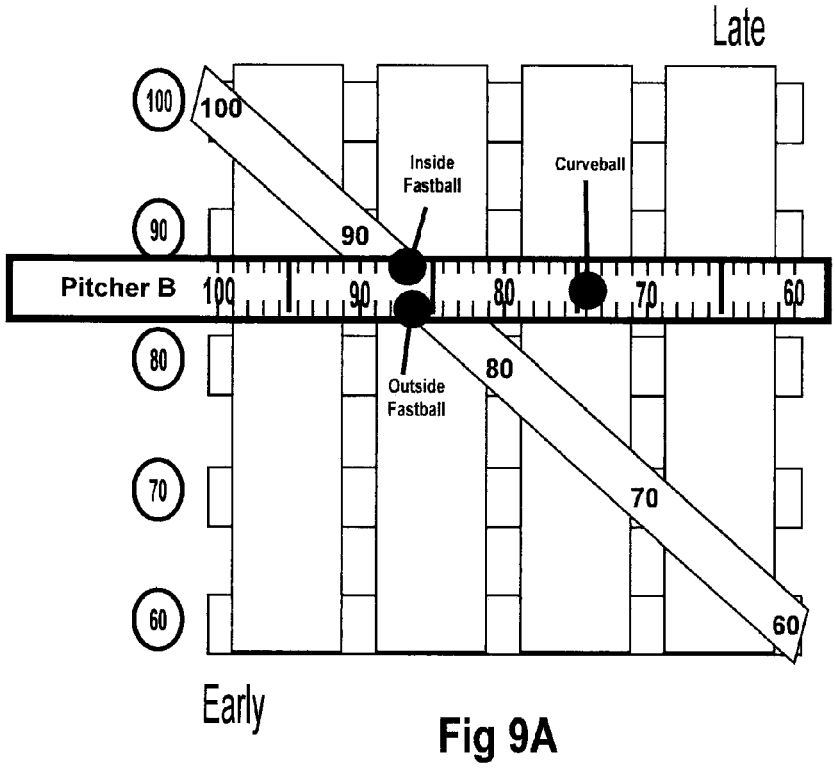
FIGS. 9A-9B graphically illustrate adjusted or effective speeds of various pitches.
Figure 9B:
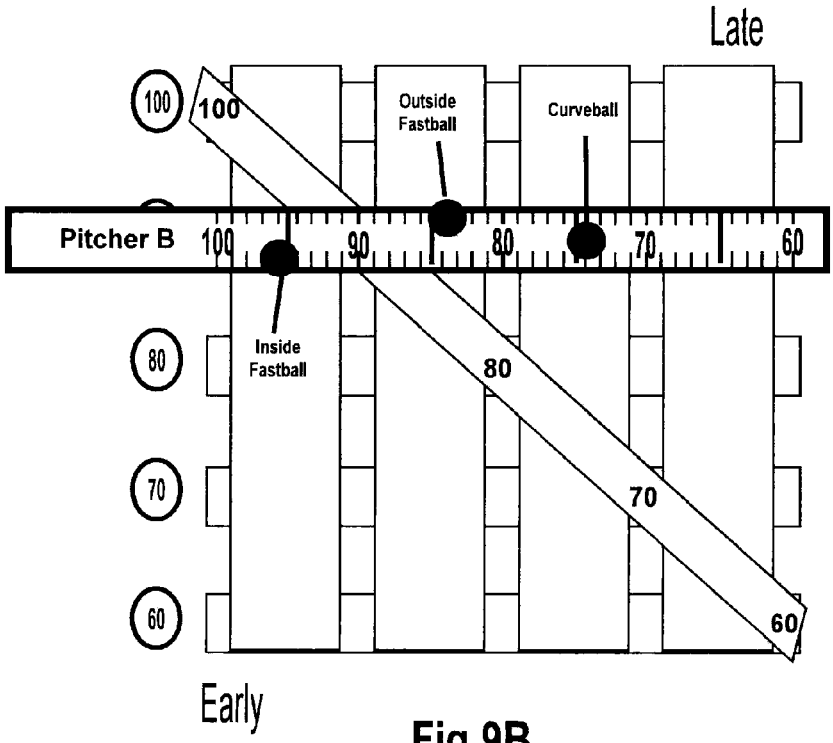

Attention now turns to applications of the above described effective velocities EV. Advantageously, the calculation of such effective velocities has benefits for both pitchers 10 and hitters 12. For pitchers 10, it has been found that batters 12 tend to focus (perhaps subconsciously) on patterns of effective velocities. That is, they begin to anticipate subsequent pitches having effective velocities near the effective velocities of past pitches. A pitcher 10 having knowledge of the EV of his past pitches can thus vary both pitch speed and pitch destination, in order to vary the EV of his subsequent pitches and keep hitters 12 off guard. Prior to this, pitchers often thought to vary one of either pitch speed or pitch destination, but not both. Similarly, pitchers 10 were not aware that different combinations of speed and pitch location can have the same or similar EV. Consequently, pitchers 10 armed with the methods of the present invention can avoid subsequent combinations of speed and pitch location that were different than those of past pitches, but that still had similar EV values to those of past pitches. Armed with the methods of the invention then, pitchers 10 can be more effective. A graphical illustration of this can be found in FIGS. 9A-9B, which represent graphs of pitch speed versus time, where the diagonal line represents the time at which hitters 12 swing the bat in order to hit pitches they perceive to be traveling at those velocities. Different pitches can be plotted on this graph, with many close to the diagonal line (e.g., FIG. 9A) indicating that the pitcher 10 tends to pitch with effective velocities close to those the batter 12 may hit if he perceives a pitch of that speed. Such a grouping of pitches indicates to pitchers 10 that they should alter their pitch patterns so as to change the effective velocities of their pitches. Conversely, many pitches away from the diagonal (e.g., FIG. 9B) indicates that the pitcher 10 tends to pitch with effective velocities different than those the batter 12 will typically hit if he perceives a pitch of that speed. This grouping of pitches indicates that pitchers 10 are "EV efficient" at that effective velocity, pitching different pitches than the batter 12 may be expecting.

For batters 12, knowledge of the EV values of past pitches, and particularly patterns of EV values from a particular pitcher, can assist the batter 12 in anticipating future pitches. As an example, if a pattern of pitches having particular EV values is recognized, the batter 12 can anticipate subsequent pitches having differing EV values. As a corollary to this, the batter 12 can be made aware that varying EV values means varying both speed and location, and that some different pitch speeds/locations can be eliminated as they have similar EV values to past pitches, even if their speed or location are different. Accordingly, the invention encompasses the determination of patterns of EV values from a pitcher 10 (which can be any recognizable number pattern), and the identification of likely future pitches that deviate from this pattern.

The methods of the invention, and particularly the calculation of EV values, have many applications. In one such application, hitters can reinforce their training by use of both EV values along with associated audio signals. For example, audio signals such as those stored on conventional audio CDs can be used in conjunction with current visualization techniques. Hitters 12 currently visualize anticipated pitch types and velocities as part of their training. This can be extended to include the use of effective velocities, where hitters 10 visualize pitches of certain effective velocities, while the sound associated with a pitch of that effective velocity is selected from the audio CD and played. Thus, while they are visualizing a pitch of that type, batters 12 can hear the sound that pitch would make, followed perhaps by the sound of that pitch being hit.

In another application, hitters 12 can be shown visual images of spin types that they can expect to see from certain pitchers 10. Visually, hitters 12 would train by watching spins of pitches they would want to hit, and would not want to hit. This can be done in two ways. First, hitters 12 can watch video close-up of a pitcher 10 releasing pitches, watching the associated spin patterns. Second, pitchers 10 can pitch live balls of that spin to the hitter 12. In both cases, the pitches are thrown at the same effective velocities that the batter 12 can expect to see, thus better preparing batters 12 for pitches of those effective velocities and spins.

A next application involves hitting with bats or other objects that have different weights than the bats that hitters 12 typically use. Such "time training sticks" simply anything that can be utilized by a hitter 12 in a bat-like fashion for striking the ball 14, and are used to throw off a body's sense of timing, on the theory that it then fights to regain the lost sense of timing, making the body more immune to bad timing. Accordingly, hitters 12 can train with balls 14 or other objects thrown at effective velocities they may be expecting from pitchers 10, hitting them with time training sticks so as to improve their immunity to bad timing.

With reference to FIG. 1, a final application involves combining the measurement device 22, computer 24, and display 26 into a single integrated unit, so as to provide a single integrated unit similar to the measurement device 22 but able to measure pitch speeds, as well as calculate and display information related to effective velocities. Such integration can be accomplished by known design and manufacturing methods, such as by combining the velocity measurement circuitry of a radar gun into a single housing along with a microprocessor or other known computing unit for calculating effective velocity from the measured velocities, and a small display for displaying the results.

Consistent with aspects of the innovations herein, for example, such processing/computing may be implemented via a computer readable medium having computer executable instructions thereon for processing a method of analyzing a pitched ball from a pitcher to a batter that are separated by a first distance, wherein an exemplary method may comprise measuring a first speed of the ball thrown over the first distance, locating a destination of the ball within a region proximate to the batter, and determining a second speed of the ball calculated from the first speed of the ball and the destination. Methods embodied on such computer readable media may comprise and/or include any of the features set forth or incorporated herein.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. Many modifications and variations are possible in view of the above teachings. For example, the invention is not limited to the subdividing of strike and/or pressure zones into a 5×5 array, nor is it limited to strike and pressure zones, but can encompass the subdividing of any area near a batter 12 into an arbitrary number and configuration of subdivisions. Also, while baseball is provided as a context for embodiments of the invention herein, the invention is not limited to this game, but instead can be applied to analyze projected objects in any sport that utilizes them. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A non-transitory computer readable medium having computer executable instructions thereon for performing analysis of a pitched ball from a pitcher to a batter that are separated by a first distance, the computer executable instructions including instructions configured to operate one or more computer devices to perform the steps of:

processing a measured first speed of the ball thrown over the first distance;

processing a destination of the ball within a region proximate to the batter; and determining a second speed of the ball calculated from the first speed of the ball and the destination;

wherein the processing a destination involves dividing the region into an array of subregions, and selecting the subregion intersected by the ball; and wherein the determining further comprises:

calculating a time unit over which the ball travels a second distance;

determining a time period during which the ball travels the first distance;

calculating a modified pitch speed according to a ratio of the first distance to the time period incremented by the time unit;

calculating a velocity adjustment unit according to a difference between the first speed and the modified pitch speed;

assigning multiplier values to the subregions, the multiplier values calculated so as to facilitate a contact of the ball by the batter;

selecting from the multiplier values the multiplier value assigned to the selected subregion; and calculating the second speed according to the sum of the first speed and the product of the selected multiplier value and the velocity adjustment unit.

2. The non-transitory computer readable medium of claim 1 wherein the region proximate to the batter includes a strike zone and a pressure zone surrounding the strike zone.

3. The non-transitory computer readable medium of claim 1 wherein the processing a destination further involves dividing the region into an array of subregions, and selecting the subregion intersected by the ball.

4. The non-transitory computer readable medium of claim 1 wherein the array of subregions is a 5×5 array representing 5 lateral location lanes having differing distances from the batter, and representing 5 elevation levels having differing heights relative to the batter.

5. The non-transitory computer readable medium of claim 1 wherein the multiplier varies as a function of the destination of the ball being located within zones across the region proximate to the batter, wherein the zones includes a strike zone and a pressure zone surrounding the strike zone.

6. The non-transitory computer readable medium of claim 1 wherein the computer executable instructions include instructions for processing information to display the second speed on a display.

7. A system configured to analyze a pitched ball, the system comprising:

a computer;

one or more computer readable media associated with the computer, the computer readable media having computer executable instructions thereon for performing analysis of the pitched ball from a pitcher to a batter that are separated by a first distance, the computer executable instructions including instructions operable in connection with the computer to perform the steps of:

processing a measured a first speed of the ball thrown over the first distance;

processing a destination of the ball within a region proximate to the batter; and determining a second speed of the ball calculated from the first speed of the ball and the destination;

wherein the processing a destination involves dividing the region into an array of subregions, and selecting the subregion intersected by the ball; and wherein the determining further comprises:

calculating a time unit over which the ball travels a second distance;

determining a time period during which the ball travels the first distance;

calculating a modified pitch speed according to a ratio of the first distance to the time period incremented by the time unit;

calculating a velocity adjustment unit according to a difference between the first speed and the modified pitch speed;

assigning multiplier values to the subregions, the multiplier values calculated so as to facilitate a contact of the ball by the batter;

selecting from the multiplier values the multiplier value assigned to the selected subregion; and calculating the second speed according to the sum of the first speed and the product of the selected multiplier value and the velocity adjustment unit.

8. The system of claim 7 wherein the region proximate to the batter includes a strike zone and a pressure zone surrounding the strike zone.

9. The system of claim 7 wherein the locating further comprises dividing the region into an array of subregions, and selecting the subregion intersected by the ball.

10. The system of claim 7 wherein the multiplier varies as a function of the destination of the ball being located within zones across the region proximate to the batter, wherein the zones includes a strike zone and a pressure zone surrounding the strike zone.

11. The system of claim 7 wherein the computer executable instructions include instructions for processing information to display the second speed on a display.

12. The system of claim 7 wherein the array of subregions is a 5×5 array representing 5 lateral location lanes having differing distances from the batter, and representing 5 elevation levels having differing heights relative to the batter, wherein different subregions correspond to different reach points or reaction times associated with the hitter.

13. The system of claim 7 wherein the system is configured to provide visual output information, the visual output information corresponding to a representation of the ball and a representation of a motion of a ball projected consistent with the second speed.

14. A non-transitory computer readable medium having computer executable instructions thereon for performing analysis of a pitched ball from a pitcher to a batter that are separated by a first distance, the computer executable instructions including instructions configured to operate one or more computer devices to perform the steps of:

processing a measured first speed of the ball thrown over the first distance;

processing a destination of the ball within a region proximate to the batter; and determining a second speed of the ball calculated from the first speed of the ball and the destination;

wherein the processing a destination involves dividing the region into an array of subregions, and selecting the subregion intersected by the ball; and wherein the determining further comprises determining a mathematical expression including a second speed and quantifying a hit reaction value for the pitched ball that embodies timing information as to when the batter should swing the bat to strike the ball, wherein the mathematical expression is calculated from the first speed of the ball and a product of a velocity and a multiplier corresponding to a numerical value that varies according to spatial location of the pitch arrival destinations relative to the batter, wherein the multiplier and the first mathematical expression increase as spatial locations of the pitch destinations transition along positions of greater height above ground, and wherein the multiplier and the first mathematical expression increase as spatial locations of the pitch destinations transition along positions incrementally closer to the batter in a lateral direction.

15. The non-transitory computer readable medium of claim 14 wherein the region proximate to the batter includes a strike zone and a pressure zone surrounding the strike zone.

16. The non-transitory computer readable medium of claim 14 wherein the processing a destination further involves dividing the region into an array of subregions, and selecting the subregion intersected by the ball.

17. The non-transitory computer readable medium of claim 14 wherein the array of subregions is a 5×5 array representing 5 lateral location lanes having differing distances from the batter, and representing 5 elevation levels having differing heights relative to the batter, wherein different subregions correspond to different reach points or reaction times associated with the hitter.

18. The non-transitory computer readable medium of claim 14 wherein the multiplier varies as a function of the destination of the ball being located within zones across the region proximate to the batter, wherein the zones includes a strike zone and a pressure zone surrounding the strike zone.

19. The non-transitory computer readable medium of claim 14 wherein the computer executable instructions include instructions for processing information to display the second speed on a display.

20. The non-transitory computer readable medium of claim 14 further including instructions to process visual output information, the visual output information corresponding to a representation of the ball and a representation of a motion of a ball projected consistent with the mathematical expression.

* * * * *